US007750887B2

(12) United States Patent
Bergquist

(10) Patent No.: US 7,750,887 B2
(45) Date of Patent: Jul. 6, 2010

(54) DISPLAYS WITH LARGE DYNAMIC RANGE

(75) Inventor: Johan Bergquist, Tokyo (JP)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 866 days.

(21) Appl. No.: 11/645,018

(22) Filed: Dec. 21, 2006

(65) Prior Publication Data

US 2008/0150864 A1 Jun. 26, 2008

(51) Int. Cl.
*G09G 3/36* (2006.01)

(52) U.S. Cl. ..... 345/102; 345/88

(58) Field of Classification Search ..... 345/87–102, 345/204

See application file for complete search history.

(56) References Cited

U.S. PATENT DOCUMENTS

| | | | | |
|---|---|---|---|---|
| 6,285,346 | B1 * | 9/2001 | Melnik et al. | 345/87 |
| 6,424,329 | B1 | 7/2002 | Okita | |
| 6,903,718 | B2 * | 6/2005 | Son | 345/102 |
| 7,002,540 | B2 * | 2/2006 | Aoki | 345/89 |
| 7,365,729 | B2 * | 4/2008 | Hong | 345/102 |
| 7,652,655 | B2 * | 1/2010 | Kim | 345/102 |
| 2002/0060662 | A1 | 5/2002 | Hong | |
| 2005/0068335 | A1 * | 3/2005 | Tretter et al. | 345/619 |
| 2005/0162360 | A1 * | 7/2005 | Ishihara et al. | 345/89 |
| 2005/0231496 | A1 * | 10/2005 | Kim et al. | 345/204 |
| 2006/0132405 | A1 * | 6/2006 | Bai et al. | 345/88 |
| 2006/0146389 | A1 | 7/2006 | Selbrede | |
| 2006/0209012 | A1 | 9/2006 | Hagood, IV | |
| 2006/0250325 | A1 | 11/2006 | Hagood et al. | |
| 2007/0200807 | A1 * | 8/2007 | Lee et al. | 345/88 |
| 2007/0252797 | A1 * | 11/2007 | Huang et al. | 345/87 |
| 2008/0074372 | A1 * | 3/2008 | Baba et al. | 345/89 |
| 2008/0079673 | A1 * | 4/2008 | Liu et al. | 345/87 |
| 2008/0224979 | A1 * | 9/2008 | Lee et al. | 345/92 |

FOREIGN PATENT DOCUMENTS

| | | |
|---|---|---|
| EP | 1 091 342 | 4/2001 |
| WO | 2006/077545 | 7/2006 |

OTHER PUBLICATIONS

A gray-scale addressing technique for thin-film-transistor/liquid crystal displays, P.M. Alt, et al, IBM J. Res. Develop. vol. 36, No. 1 Jan. 1992.

Time multiplexed optical shutter (TMOS) display technology for avionics platforms, M. Selbrede, B. Yost, Unipixel Displays, Inc. and Lockheed Martin Systems Integration-Owego, SPIE, publ. 2006.

Evaluation of Multispectral Imaging, Yoichi Miyake and Kimiyoshi Miyata, Colour Image Science, 2002.

* cited by examiner

*Primary Examiner*—Nitin Patel

(57) ABSTRACT

The specification and drawings present a new method, apparatus and software product for increasing a grey dynamic range of a display for displaying video data by providing a grey level, calculated for a reduced number of primary colors using a predetermined criterion, for each field of a frame set by the display by varying an amplitude or a subfield composition of a display driving signal and by varying a fluence of simultaneously lit backlight sources (e.g., LEDs) corresponding to selected two or more primary colors of the display. Thus, grey level resolution of the display can be increased to match the higher grey level resolution of the video data provided to the display.

28 Claims, 5 Drawing Sheets

DISPLAYS WITH LARGE DYNAMIC RANGE

TECHNICAL FIELD

The present invention relates generally to displays or electronic devices with displays and, more specifically, to increasing a grey level dynamic range of the displays.

BACKGROUND ART

High-quality imaging requires a large dynamic range to render all possible grey levels. While cameras have made great progress both in terms of dynamic range and resolution, displays for playing back such images are still missing, except for high-end medical displays. With advanced cameras entering mobile phones, there is an increased need to playback images accurately also on consumer displays, particularly mobile displays. In order to render the entire dynamic range of the image, the display needs to 1) exhibit large contrast ratio both in dark and bright environments and 2) have a large number of addressable grey levels. To maintain readability in bright environments, it is common to tune the tone rendering curve (TRC) or gamma according to ambient light. In order to do that, however, more grey levels are needed in order not to lose the number of distinguishable grey levels. Mobile displays have traditionally been utilizing transflective displays to preserve the contrast and thus readability in a variety of luminous environments. However, there is a trade-off between color reproduction range (gamut) and luminance in the reflective mode so some recent displays have abolished reflective color all together in favor of higher monochrome contrast and brightness, thus enhancing readability in bright environments. Problems with transflective displays are high manufacturing costs and limited resolution compared to transmissive or fully reflective displays. This limited resolution and the need for wider gamut has led to a trend towards more transmissive and emissive displays. In order to achieve outdoor readability, however, a large luminance and hence a high-power backlight, is needed. For conventional transmissive or emissive displays, currently there is no method for trading color range for brightness in the same way as for transflective displays—trading is fixed and determined by the reflective/transmissive aperture ratios and the color filter spectra. By contrast, a recently proposed field-sequential-color display with adaptive gamut can provide a continuous exploitation of this trade-off. However, it is limited to the same (small) number of addressable grey levels as conventional displays and therefore cannot render images with a large dynamic range.

Electronic displays based on an analogue material response, e.g., liquid crystal displays (LCDs) or organic light emitting diode displays (OLEDs) require a digital-to-analog converter (DAC) in order to translate the digital image data to actual images on the display. Because of cost and power considerations, the resolution of these DACs is limited, particularly for mobile displays. The widely used 6-bit DACs enable a 6 bit grey scale for each primary which, for an RGB display gives 18 bits per pixel (bpp) or $2^{3\times6}$=262,144 addressable colors. This color depth is often extended to 24 bpp by using frame rate control (FRC), i.e., temporal averaging of several frames to achieve the extra 6 bits needed. While this is a cost and power efficient solution, it sacrifices moving image quality since the refresh rate for certain grey levels is lowered.

Increasing the resolution of DACs is straightforward but results in higher cost and increased power consumption, even for moderate color depths like 24 bpp. 10-12 bit DACs are available for medical displays but they are expensive and need precise calibration with laser-tuning. The FRC provides a simple means of extending the color depth but at the expense of moving image quality. Since conventional displays have fixed primary colors, there is no way to trade color for dynamic range. Thus the dynamic range of the primary color with least bpp will limit the dynamic range in monochrome or multi-color images.

Conventional LCDs and OLEDs are spatially divided into picture elements (pixels) which, in turn, are spatially divided into individually addressable subpixels which represent each primary color, e.g., RGB (red, green, blue). In the case of LCDs, white light from the surroundings (reflective displays) or from the backlight (transmissive displays) is filtered through primary color filters on the subpixels to form pixels of any color. Field sequential color displays (FSCDs) are transmissive displays without subpixels or color filters and the image is instead formed by a sequence of images separated into each primary color, e.g. RGB. This sequence is faster than the integration time of the human visual system (HVS) so the colors are "fused" in the brain

DISCLOSURE OF THE INVENTION

According to a first aspect of the invention, a method, comprises: receiving a video data signal comprising video data for a display in an electronic device; calculating for each field of a frame set by the display a grey level for expanding a grey dynamic range of the display for displaying the video data for a reduced number of primary colors in the display using a predetermined criterion; and providing the grey level for the each field by varying an amplitude or a subfield composition of a display driving signal and by varying a fluence of simultaneously lit backlight sources corresponding to selected two or more primary colors of the display.

According further to the first aspect of the invention, the fluence may be varied by varying at least one of: a) a field duty of the backlight sources and b) a peak intensity of the backlight sources.

Still further according to the first aspect of the invention, a fluence ratio of two consecutive fields in the frame may be equal to two or one half.

According further to the first aspect of the invention, the display may be a field sequential color display.

According still further to the first aspect of the invention, the display may be a liquid crystal display device or a micro-electro-mechanical systems display.

According still further to the first aspect of the invention, the two or more primary colors may be red, green and blue.

According yet further still to the first aspect of the invention, the display may be a single-hue display.

Yet still further according to the first aspect of the invention, the display may be a two-or more-primary color display and the calculating and providing may be performed for each primary color.

Still yet further according to the first aspect of the invention, the backlight sources may be light emitting diodes.

Still further still according to the first aspect of the invention, each frame may have one or more fields.

According further still to the first aspect of the invention, the grey level for the each field may be provided by varying the subfield composition of the display driving signal and by varying the fluence by varying the peak intensity of the backlight sources.

According to a second aspect of the invention, a computer program product comprising: a computer readable storage structure embodying computer program code thereon for execution by a computer processor with the computer program code, wherein the computer program code comprises instructions for performing the first aspect of the invention, indicated as being performed by any component or a combination of components of the electronic device.

According to a third aspect of the invention, an electronic device with a display, comprises: a field selector, for defining fields of a frame for primary colors; and a controller, for receiving a video data signal comprising video data for the display, for calculating for each field of the fields a grey level for expanding a grey dynamic range of the display for displaying the video data for a reduced number of primary colors in the display using a predetermined criterion, and for providing the grey level for the each field by varying an amplitude or a subfield composition of a display driving signal and by varying a fluence of simultaneously lit selected two or more primary colors using backlight sources of the display.

Further according to the third aspect of the invention, the controller may be configured to provide the grey level for the each field by varying the subfield composition of the display driving signal and by varying the fluence by varying the peak intensity of the backlight sources.

Still further according to the third aspect of the invention, the controller may be configured to vary the fluence by varying at least one of: a) a field duty of the backlight sources and b) a peak intensity of the backlight sources.

According further to the third aspect of the invention, a fluence ratio of two consecutive fields in the frame may be equal to two or one half.

According still further to the third aspect of the invention, the display may be a field sequential color display.

According yet further still to the third aspect of the invention, the display may be a liquid crystal display device or a micro-electro-mechanical systems display.

According further still to the third aspect of the invention, the two or more primary colors may be red, green and blue.

Yet still further according to the third aspect of the invention, the display may be a single-hue display.

Still yet further according to the third aspect of the invention, the display may be a two-or more-primary color display and the calculating and providing may be performed for each primary color.

Still further still according to the third aspect of the invention, the display may comprise the backlight sources and the backlight sources may be light emitting diodes.

Yet still further according to the third aspect of the invention, each frame may have one or more fields.

Still yet further still according to the third aspect of the invention, the display may comprise the field selector and the controller.

According to a fifth aspect of the invention, an electronic device with a display, comprises: selecting means, for defining fields of a frame for primary colors; and controlling means, for receiving a video data signal comprising video data for the display, for calculating for each field of the fields a grey level for expanding a grey dynamic range of the display for displaying the video data for a reduced number of primary colors in the display using a predetermined criterion, and for providing the grey level for the each field by varying an amplitude or a subfield composition of a display driving signal and by varying a fluence of simultaneously lit selected two or more primary colors using backlight sources of the display.

According further to the fifth aspect of the invention, the selecting means may be a field selector.

BRIEF DESCRIPTION OF THE DRAWINGS

For a better understanding of the nature and objects of the present invention, reference is made to the following detailed description taken in conjunction with the following drawings, in which.

MODES FOR CARRYING OUT THE INVENTION

Figure 1:
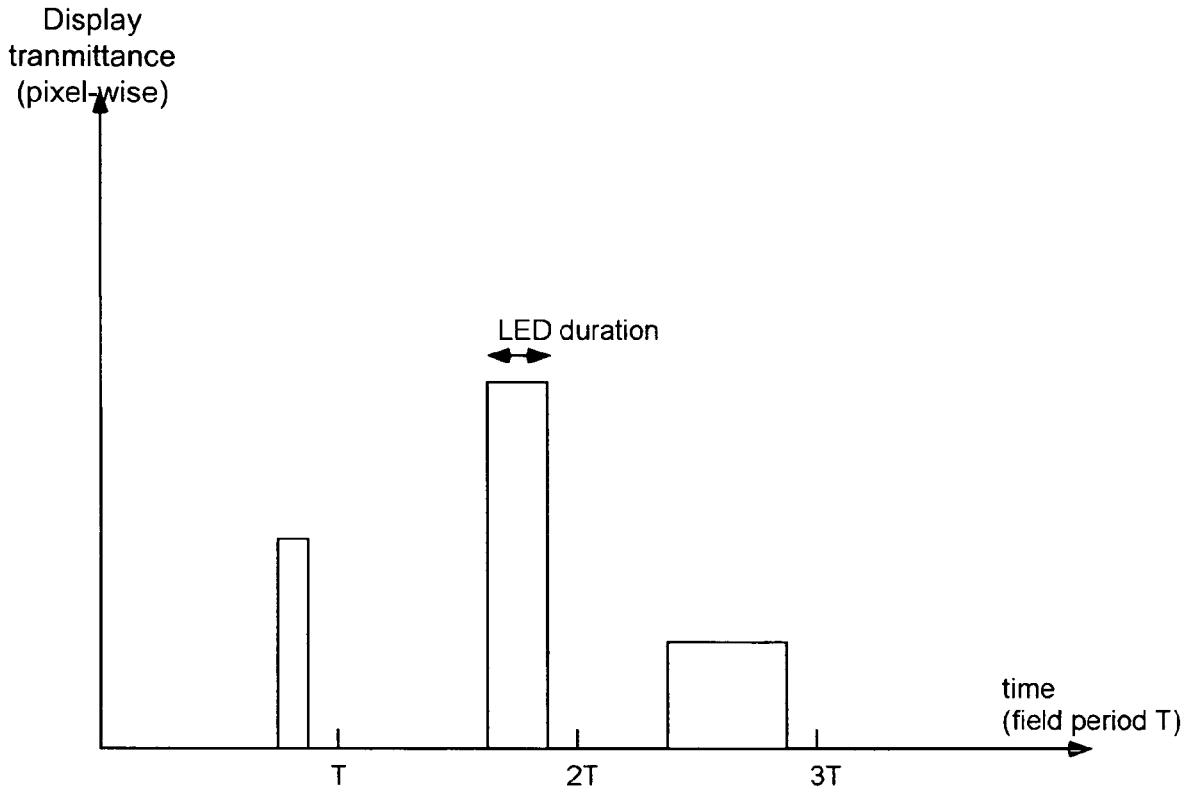
FIG. 1 is a timing diagram of a display (e.g. LCD) transmittance demonstrating increasing a grey dynamic range of a display with three-primary (RGB) in monochrome operation of a field sequential color display (FSCD), wherein all three backlight sources turned on at the same time by using corresponding bit weights in the field durations, i.e., varying duties and therefore fluence of the backlight sources such as LEDs, in addition to varying a field-averaged transmission amplitude of a display driving signal, according to an embodiment of the present invention.

A new method, apparatus and software product is presented for increasing a grey-level dynamic range of a display for displaying video data by providing a grey level, calculated for a reduced number of primary colors using a predetermined criterion, for each field of a frame set by the display by varying an amplitude or a subfield composition of a display driving signal and by varying a fluence of simultaneously lit backlight sources (e.g., light emitting diodes, LEDs) corresponding to selected two or more primary colors of the display. Thus, grey level resolution of the display can be increased to match the higher grey level resolution of the video data provided to the display.

According to an embodiment of the present invention, the fluence can be varied by varying at least one of: a) a field duty of the backlight sources and b) a peak intensity of the backlight sources. The display can be, e.g., a field sequential color display (FSCD) with any number of primaries and any number (one or more) of fields (typically three or more), the latter is typically larger or equal to the former. Also, according to embodiments of the present invention, the display can be, but is not limited to, a liquid crystal display (LCD), a micro-electro-mechanical systems (MEMS) display, or any kind of spatial light modulator. Also, LCD and MEMS devices utilizing different optical path configuration can be used, including (but not be limited to) a direct-view display, a near-to-the-eye display, a projector display, etc. The backlight sources can be, but are not limited to inorganic or organic light emitting diodes, fluorescent discharge lamps, field emitters with phosphors, etc.

According to a further embodiment, the display (e.g., a light modulator) can be a monochrome (or single-hue) display such that, during each field, white or pseudo-white light and/or other native primary color light sources can be turned on to create a display with a reduced number of primaries. For example, a one-primary (monochrome) achromatic display can be achieved by turning on all (native) primary color light sources during each field. A red-green-blue (RGB) FSCD, for example, could have a sequence of RGB, RGB, RGB instead of R, G, B. Likewise, a bi-color display can be achieved, for example, by a sequence of two combinations of the available light source colors, e.g. [R,G], [R,B], [G,B], [RG,BR], [RG, BG], or [BG,BR]. The three latter correspond to the sequences of complementary (and brighter) colors cyan (C), magenta (M), and yellow (Y), [Y,M], [Y,C], and [C,M]. Similarly, a six-primary FSCD can be reduced to a three-primary FSCD display by showing any combination of two native primaries twice during one frame. The display can be still driven by the original number of fields, e.g. 3 or 4 for a three-primary display, e.g., RGB or RGBG, but each native primary color light source will be lit at least twice during each frame but with the possibility of having different field-averaged display transmittances and different fluences of backlight sources (e.g., LEDs) during different fields. This, in turn, can translate to a larger number of grey levels via the temporal averaging of the fields showing subject to the same combination of primary light sources. The additional grey levels can be accomplished by varying the fluence of the backlight sources (e.g., LEDs) e.g. by using pulse width modulation (PWM) with the widths corresponding to the weights of the additional binary digits as illustrated in FIG. 1.

FIG. 1 is an example among others of a timing diagram of a display (e.g., LCD) transmittance demonstrating increasing a grey dynamic range of a display with three-primary (RGB) in monochrome operation of the field sequential color display (FSCD), wherein all three backlight sources turned on at the same time by using corresponding bit weights in the field durations, i.e., varying duties (by pulse width modulation) and therefore fluence of the backlight sources such as LEDs, in addition to varying a field-averaged transmission amplitude (e.g., an amplitude and/or subfield composition) of a display driving signal, according to an embodiment of the present invention. The fluence (i.e., the pulse width times the intensity/luminance) ratio of two consecutive fields in the frame is equal to two, as shown in FIG. 1. This fluence ratio of the two consecutive fields can be set, e.g., to one half as well, because the order of fields does not matter since the eye integrates temporally. In contrast to the FRC (frame rate control), the averaging can be carried out within one frame so there is no negative effect on moving image quality. The result is that images can be displayed with fewer primaries than the nominal number of primaries but with a larger grey dynamic range, i.e., a trading of color reproducibility for the larger grey dynamic range. The calculation of the command grey levels of each field for an FSCD in monochrome operation is outlined below.

It is assumed that N is the number of fields for the used primary color, i is the field index $i \in [0 \ldots N-1]$, $n_i$ is a number of bits for the field with field index i (supported by the display's DAC), $L_i$ is the digital command value in the field with field index i, $L_{max}$ is the maximum grey level of a monochrome display or of a primary of a display with reduced number of primaries, and L is the desired grey level contained in the video data signal (for each pixel and primary color) and provided by a system that uses the display (it typically has larger bit depth than the display DAC capability), $L \in [0 \ldots L_{max}]$. $L_0$ (for the field index i=0) then can be calculated as follows:

$$L_0 = L - \sum_{k=1}^{N-1} L_k 2^k, \tag{1}$$

wherein $L_N$ is set to zero (since the field index i runs from 0 to N−1), and the grey level of the field i for a monochrome display can be then given by $$L_i = INT\left(\frac{L - \sum_{k=i+1}^{N-1} L_k 2^k - \sum_{J=0}^{i-1} 2^{n_J} 2^j}{2^i}\right) + 1. \tag{2}$$

Thus $L_i$ is calculated using L, the number of fields N, and the native color depth (e.g., DAC resolution) defined by $n_i$ for each field.

The total number of available grey levels for a monochrome display can be calculated as $$L_{\max} = \sum_{i=1}^{N-1} 2^{i-1} 2^{n_i}. \tag{3}$$

Equations 1-3 refer to the case of the monochrome display so all available fields N are used for one single primary color which, for each field, is controlled by the relative duties (or peak intensities as discussed in regard to FIG. 2 below) of the backlight sources (e.g., LEDs) of the original field sequential color display, e.g. R, G, B. A display with M primaries would then need N×M fields to operate with the same number of grey levels per primary as for the monochrome one. $L_{max}$ could be defined separately for each primary because some colors need larger dynamic range, e.g., green. A 16 bpp display, for example, usually has 5 bit for red, 6 bit for green, and 5 bit for blue. It would also be possible to dynamically move bit depth between the primaries depending on the image content and/or viewing conditions. For simplicity, the Equations 1-3 are for the case of one primary (monochrome) but they can be generalized to any number of primaries as long as the display device response supports the corresponding number of fields.

For example, a three-field display with 24 bpp (bit per pixel) then yields $L_{max}=2^0\times2^8+2^1\times2^8+2^2\times2^8=256+2\times256+4*256=1792$ levels for monochrome images. This corresponds to log 1792/log 2=10.8 bpp, i.e., an increase in bit depth by 2.8 bits. If four fields are allowed, the number increases by 8*256 to 3840, corresponding to 11.9 bits. Furthermore, if two frames and four fields are used for time-averaging, the number increases by 16*256+32*256+64*256+128*256 to 65280 or 16 bit grey scale. A four-field FSCD with 8-bit DACs (digital-to-analog converters) used in a bi-color configuration would yield 768 levels per color. Together with the available field rate, only flicker and moving image quality will eventually limit the number of grey levels for this temporal averaging.

The grey levels can be calculated by using Equation 2 which determines the value of the field-averaged amplitude of the signal provided to the display. The binary weights that add grey levels can be implemented by varying the duty (using pulse width modulation) of the light sources, e,g, LEDs, individually for each field as shown in FIG. 1 or/and by varying peak intensities of the light sources, such as LEDs as shown in FIG. 2*a*.

Figure 2A:
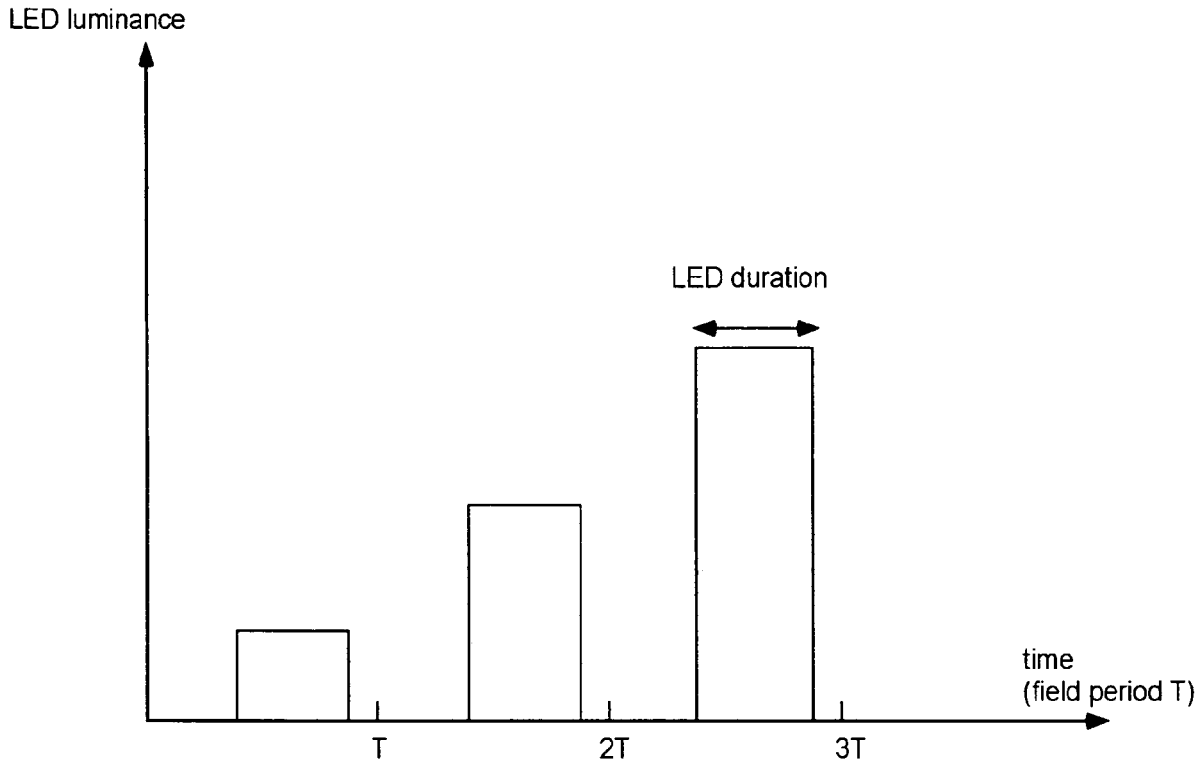
FIG. 2*a* is a timing diagram of luminance of backlight sources (e.g., LEDs) for increasing a grey dynamic range of a display with three-primary (RGB) in monochrome operation of a field sequential color display (FSCD), wherein all three light backlight sources are turned on at the same time by using corresponding bit weights in the LED intensities, controlled by either number of LEDs or the total current of an ensemble of LEDs, according to an embodiment of the present invention.

FIG. 2*a* shows one example among others of a timing diagram of luminance (or fluence) of backlight sources (e.g., LEDs) for increasing a grey dynamic range of a digitally modulated display with three-primary (RGB) in monochrome operation of the field sequential color display (FSCD), wherein all three light backlight sources turned on at the same time by using a corresponding bit weights in the LED intensities, according to an embodiment of the present invention. The fluence ratio (i.e., the ratio of peak intensities) of two consecutive fields in the frame is equal to two (with equal pulse widths), as shown in FIG. 2*a*. The peak intensities can be controlled, for example, by the number of LEDs (e.g., 1, 2, 4, 8, 16, etc.) or by controlling the current of an ensemble of LEDs so that the LED luminances become 1/1, 1/2, 1/4, 1/8, 1/16, etc. for each respective field.

Figure 2B:
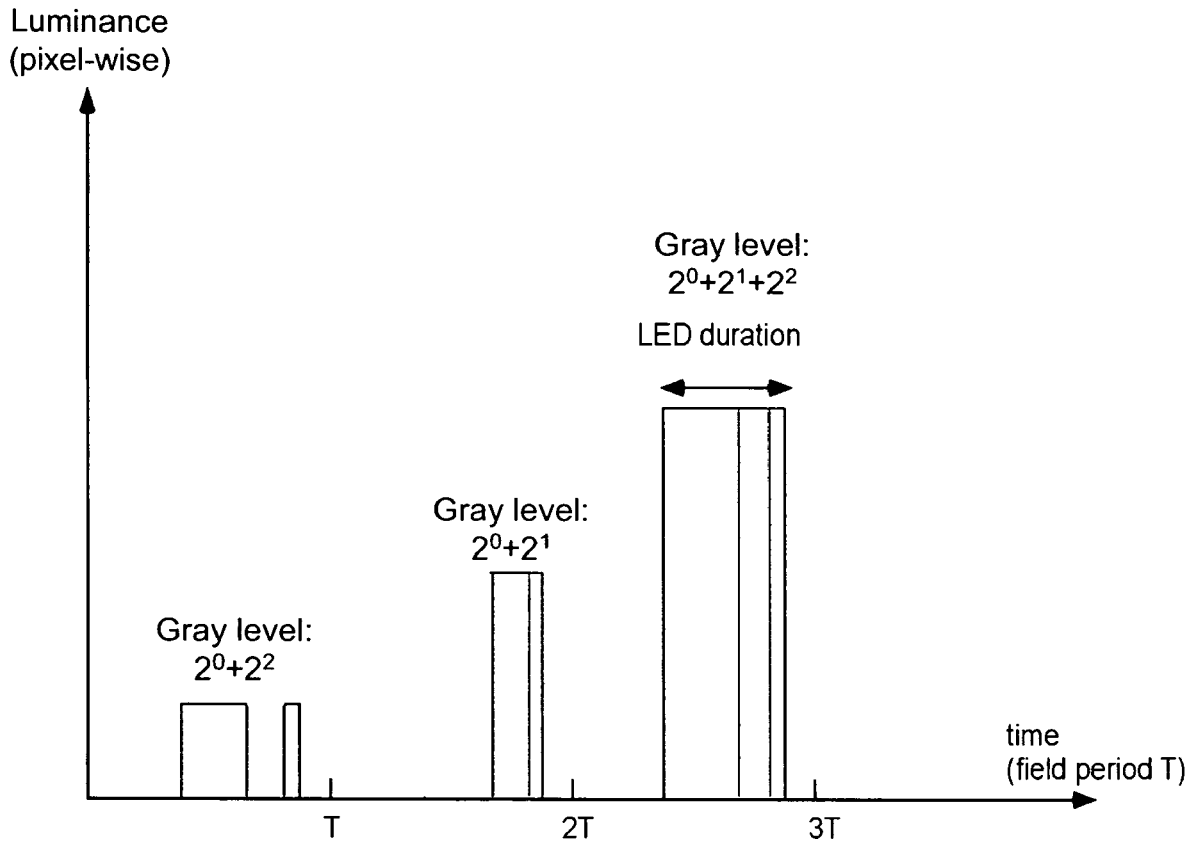
FIG. 2*b* is a timing diagram of a display luminance (pixel-wise) demonstrating increasing a grey dynamic range of a digitally modulated display with three-primary (RGB) in monochrome operation of a field sequential color display (FSCD), wherein all three backlight sources turned on at the same time by using corresponding bit weights in the LED intensities and by varying the subfield duties of the display driving signal, according to an embodiment of the present invention.

FIG. 2*b* shows another example of a timing diagram of a display luminance (pixel-wise) demonstrating increasing a grey dynamic range of a display with three-primary (RGB) in monochrome operation of a field sequential color display (FSCD), wherein all three backlight sources turned on at the same time by using corresponding bit weights in the LED intensities (as shown in FIG. 2*a*) and by varying the subfields (subfield-modulation), i.e., by varying subfield composition of the display driving signal, according to an embodiment of the present invention. For simplicity the subfield-modulation achieving the grey levels is represented by 3-bit depth $2^0+2^1+2^2$. For example, for the first field the subfield modulation corresponds to $2^0+2^1+2^2$ grey level, for the second field the subfield modulation corresponds to $2^0+2^1$ grey level, and for the third field the subfield modulation corresponds to $2^0+2^1+2^2$ grey level.

Figure 3:
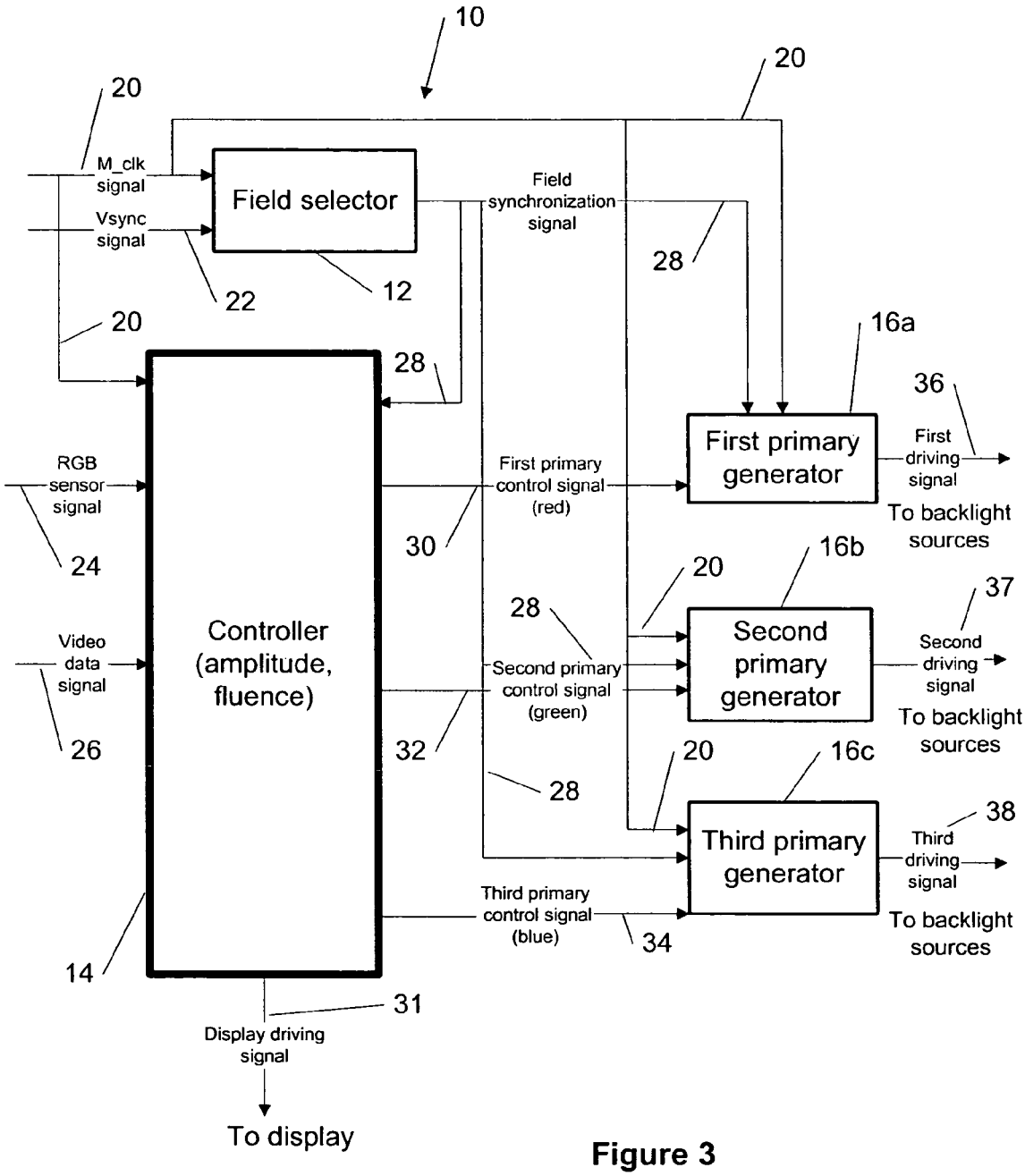
FIG. 3 is a block diagram of control and signal generating modules in an electronic device comprising a display for increasing a grey-level dynamic range of a 3-primary display, according to an embodiment of the present invention.

FIG. 3 shows an example among others of a block diagram of control and signal generating modules in an electronic device 10 comprising of a 3-primary display (which can be generalized to any number of primaries), for increasing a grey dynamic range of the display, according to an embodiment of the present invention.

The electronic device 10 can comprise a field selector 12, for defining fields of a frame for primary colors. Vsync signal 22 is the vertical sync from the video signal input, and a field synchronization signal 28 is the vertical sync for each color field which defines one or more color fields for the one or more primary colors, and M_clk signal 20 is a clock signal. In the example of FIG. 3 there are three fields and three primary colors, e.g., red (R), green (G) and blue (B).

The electronic device 10 also comprises a controller 14, which can be used for setting the field duties of the primary colors in the color fields using the predefined white-balancing procedure (if necessary). Moreover, the controller 14 is for implementing the embodiments of the present invention described herein: for receiving a video data signal comprising video data for the display, for calculating for each field of said fields a grey level for expanding a grey dynamic range of said display for displaying said video data for a reduced number of primary colors in said display using a predetermined criterion (see Equation 2), and for providing said grey level for each field by varying an amplitude of a display driving signal (see a display driving signal 31) and by varying a fluence of simultaneously lit backlight sources (see signals 30, 32 and 34) corresponding to selected two or more primary colors of the display. The display driving signal 31 provided to the display is typically an analog signal generated using a DAC of the display which can be a part of the controller or it can be a separate module. In case of the subfield modulation, described herein (see FIG. 2*a*), the signal 31 can be digital with no DAC required.

The block 14 can be responsive to, e.g., an RGB sensor signal 24 (e.g., the RGB sensor can be combined with the ambient light sensor) for performing a white-balancing procedure known in the art, responsive to a video data signal 26 and to the field synchronization signal 28, and can provide a first primary control signal 30 (e.g., red), a second primary control signal 32 (e.g., green) and a third primary control signal 34 (e.g., blue), to corresponding generators 16*a*, 16*b*, and 16*c*, respectively. Using these input signals 30, 32 and 34 (as well standard input signals 28 and 20), the blocks 16*a*, 16*b*, and 16*c* can provide driving signals 36, 37 38, respectively, to the appropriate light sources of the display in the electronic device 10, according to the various embodiments of the present invention described herein.

The input data (signal 26) can be encoded into N-primary color data which is decoded to the reduced primary representation (e.g., the signal 31), e.g., monochrome or bi-color. This task can be actually done by the controller 14. Input data can be encoded with the higher bit depth and the reduced number of primaries. However, for display interfaces with separate channels for the primaries, e.g. RGB, the expanded resolution data must be encoded into the separate RGB channels. For example, a 24-bit monochrome image can be sent with bits b0 . . . b7, b8 . . . 15, b16 . . . b23 in the R, G, and B, channels, respectively. Similarly, a 12 bpp bi-colour (a,b) image can be sent with a0 . . . a7, a8 . . . a11+b0 . . . b3, b4-b11 in the R, G, and B channels, respectively.

Furthermore, the module 14 (the same may be applicable to the module 12) can be implemented as a software or a hardware module or a combination thereof. Furthermore, the module 14 (as well as 12) can be implemented as a separate module or it can be combined with any other standard module or block or it can be split into several blocks according to their functionality. All or selected modules of the electronic device 10 can be implemented using an integrated circuit.

Figure 4:
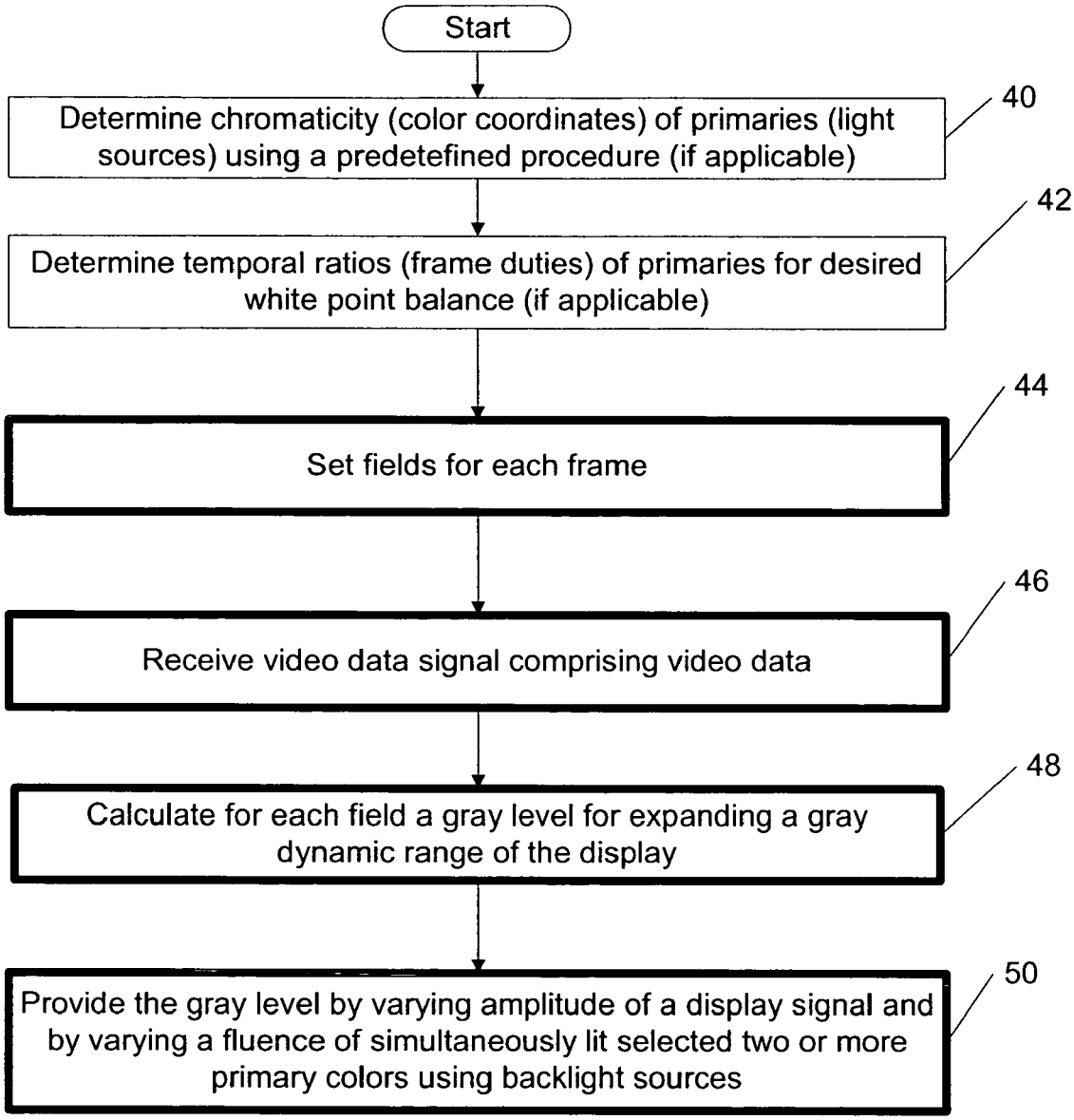
FIG. 4 is a flow chart illustrating increasing a grey-level dynamic range of a display in an electronic device, according to an embodiment of the present invention.

FIG. 4 is a flow chart illustrating an increasing a grey dynamic range of a display in an electronic device 10, according to a further embodiment of the present invention.

The flow chart of FIG. 4 only represents one possible scenario among others. The order of steps shown in FIG. 4 is not absolutely required, so generally, the various steps can be performed out of order. In a method according to an embodiment of the present invention, in a first step 40, chromaticity of the primaries (i.e., the light sources) is determined using a predefined procedure (as known in the art) and stored in the memory of the electronic device 10. In a next step 42, the temporal ratios (duties) of the primaries for the desired white point balance are determined. Steps 40 and 42 are optional and performed only if necessary for a particular application.

In a next step 44, the fields for each frame are set. In a next step 46, the video data signal 26 comprising video data is received by the controller 14.

In a next step 48, the grey level for each field is calculated for expanding the grey dynamic range of the display using a predetermined criterion (e.g., see Equation 2). Finally, in a next step 50, the desired grey level is provided by varying amplitude or subfield modulation (or subfield composition) of a display driving signal (signal 31) and by varying a fluence of simultaneously lit selected two or more primary colors using backlight sources (signals 30, 32 and 34).

As explained above, the invention provides both a method and corresponding equipment consisting of various modules providing the functionality for performing the steps of the method. The modules may be implemented as hardware, or may be implemented as software or firmware for execution by a computer processor. In particular, in the case of firmware or software, the invention can be provided as a computer program product including a computer readable storage structure embodying computer program code (i.e., the software or firmware) thereon for execution by the computer processor.

It is noted that various embodiments of the present invention recited herein can be used separately, combined or selectively combined for specific applications.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A method, comprising:

receiving a video data signal comprising video data;

calculating for each field of a frame set by a display a grey level for expanding a grey dynamic range of the display for displaying said video data for a reduced number of primary colors in said display using a predetermined criterion; and providing said grey level for said each field by varying an amplitude or a subfield composition of a display driving signal and by varying a fluence of simultaneously lit backlight sources corresponding to selected two or more primary colors of said display.

2. The method of claim 1, wherein said fluence is varied by varying at least one of: a field duty of said backlight sources and a peak intensity of said backlight sources.

3. The method of claim 1, wherein a fluence ratio of two consecutive fields in said frame is equal to two or one half.

4. The method of claim 1, wherein said display is a field sequential color display.

5. The method of claim 1, wherein said display is a liquid crystal display device or a micro-electro-mechanical systems display.

6. The method of claim 1, wherein said two or more primary colors are red, green and blue.

7. The method of claim 1, wherein said display is a single-hue display.

8. The method of claim 1, wherein said display is a two- or more-primary color display and said calculating and providing are performed for each primary color.

9. The method of claim 1, wherein said backlight sources are light emitting diodes.

10. The method of claim 1, wherein each frame has one or more fields.

11. The method of claim 1, wherein said grey level for said each field is provided by varying said subfield composition of the display driving signal and by varying said fluence by varying said peak intensity of said backlight sources.

12. A computer program product comprising:

a computer readable storage structure embodying a computer program code thereon for execution by a computer processor with said computer program code, wherein said computer program code comprises instructions for performing the method of claim 1, indicated as being performed by a component or a combination of components of an electronic device.

13. An electronic device, comprising:

a controller, configured to receive a video data signal comprising video data for a display, configured to calculate for each field of fields of a frame for primary colors a grey level for expanding a grey dynamic range of said display for displaying said video data for a reduced number of primary colors in said display using a predetermined criterion, and configured to provide said grey level for said each field by varying an amplitude or a subfield composition of a display driving signal and by varying a fluence of simultaneously lit selected two or more primary colors using backlight sources of said display.

14. The electronic device of claim 13, wherein said controller is configured to provide said grey level for said each field by varying said subfield composition of the display driving signal and by varying said fluence by varying said peak intensity of said backlight sources.

15. The electronic device of claim 13, wherein said controller is configured to vary said fluence by varying at least one of: a field duty of said backlight sources and a peak intensity of said backlight sources.

16. The electronic device of claim 13, wherein a fluence ratio of two consecutive fields in said frame is equal to two or one half.

17. The electronic device of claim 13, wherein said display is a field sequential color display.

18. The electronic device of claim 13, wherein said display is a liquid crystal display device or a micro-electro-mechanical systems display.

19. The electronic device of claim 13, wherein said two or more primary colors are red, green and blue.

20. The electronic device of claim 13, wherein said display is a single-hue display.

21. The electronic device of claim 13, wherein said display is a two or more primary color display and said calculating and providing are performed for each primary color.

22. The electronic device of claim 13, wherein said display comprises said backlight sources and said backlight sources are light emitting diodes.

23. The electronic device of claim 13, wherein each frame has one or more fields.

24. The electronic device of claim 14, wherein said display comprises said field selector and said controller.

25. An electronic device, comprising:

means for defining fields of a frame for primary colors; and means for controlling, for receiving a video data signal comprising video data for a display, for calculating for each field of said fields a grey level for expanding a grey dynamic range of said display for displaying said video data for a reduced number of primary colors in said display using a predetermined criterion, and for providing said grey level for said each field by varying an amplitude or a subfield composition of a display driving signal and by varying a fluence of simultaneously lit selected two or more primary colors using backlight sources of said display.

26. The electronic device of claim 25, wherein said selecting means is a field selector.

27. The electronic device of claim 13, further comprising a field selector, configured to define said fields of the frame for the primary colors.

28. The electronic device of claim 13, wherein said display is a part of the electronic device.

* * * * *